US006578310B1

(12) United States Patent
Schacht

(10) Patent No.: US 6,578,310 B1
(45) Date of Patent: Jun. 17, 2003

(54) FIREARM SIGHTING DEVICE

(76) Inventor: David A. Schacht, 400 Alexander St., La Crosse, WI (US) 54601

( * ) Notice: Subject to any disclaimer, the term of this patent is extended or adjusted under 35 U.S.C. 154(b) by 0 days.

(21) Appl. No.: 10/076,541

(22) Filed: Feb. 15, 2002

(51) Int. Cl.[7] ..... F41G 1/00
(52) U.S. Cl. ..... 42/112
(58) Field of Search ..... 42/111–148

(56) References Cited

U.S. PATENT DOCUMENTS

| | | | | | |
|---|---|---|---|---|---|
| 295,791 | A | * | 3/1884 | Hornback | 83/112 |
| 1,376,089 | A | * | 4/1921 | Fensdorf | 42/136 |
| 2,806,288 | A | * | 9/1957 | Sarvis | 42/136 |
| 2,855,680 | A | | 10/1958 | Christensen | |
| 3,439,970 | A | | 4/1969 | Rickert | |
| 3,777,380 | A | * | 12/1973 | Theodore | 42/144 |
| 3,840,995 | A | * | 10/1974 | Freiling | 42/148 |
| 3,975,851 | A | * | 8/1976 | Benford | 42/137 |
| D248,403 | S | | 7/1978 | Grant | |
| 4,601,121 | A | | 7/1986 | Jolly | |
| 4,679,344 | A | | 7/1987 | Jolly | |
| 4,918,823 | A | | 4/1990 | Santiago | |
| 6,058,616 | A | * | 5/2000 | Bubits | 42/144 |
| 6,068,483 | A | * | 5/2000 | Minor | 434/19 |

* cited by examiner

*Primary Examiner*—Michael J. Carone
*Assistant Examiner*—Denise J. Buckley

(57) ABSTRACT

A firearm sight for providing the user with a consistent reference point for his sighting includes an elongate member designed for mounting on a barrel of a firearm. The elongate member includes an elongate base portion for mounting on the firearm and having a proximal end and a distal end. The elongate member also includes an elongate upper portion mounted on the base portion and has a substantially V-shaped cross section. The upper portion comprises a pair of side walls. A sighting member is mounted on the elongate member, and extends between the side walls of the upper portion.

14 Claims, 3 Drawing Sheets

FIREARM SIGHTING DEVICE

BACKGROUND OF THE INVENTION

1. Field of the Invention

The present invention relates to a firearm sight and more particularly pertains to a new firearm sight for providing the user with a consistent reference point for his sighting.

2. Description of the Prior Art

The use of a firearm sight is known in the prior art. More specifically, a firearm sight heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,855,680; 3,439,970; 4,918,823; 4,679,344; 4,601,121; and Des. 248,403.

While these devices fulfill their respective, particular objectives and requirements, the aforementioned patents do not disclose a new firearm sight. The inventive device includes an elongate member being adapted for mounting on a barrel of a firearm. The elongate member includes an elongate base portion for mounting on the firearm and having a proximal end and a distal end. The elongate member also includes an elongate upper portion mounted on the base portion and has a substantially V-shaped cross section. The upper portion comprises a pair of side walls. A sighting member is mounted on the elongate member, and extends between the side walls of the upper portion.

In these respects, the firearm sight according to the present invention substantially departs from the conventional concepts and designs of the prior art, and in so doing provides an apparatus primarily developed for the purpose of providing the user with a consistent reference point for his sighting.

SUMMARY OF THE INVENTION

In view of the foregoing disadvantages inherent in the known types of firearm sight now present in the prior art, the present invention provides a new firearm sight construction wherein the same can be utilized for providing the user with a consistent reference point for his sighting.

The general purpose of the present invention, which will be described subsequently in greater detail, is to provide a new firearm sight which has many of the advantages of the firearm sight mentioned heretofore and many novel features that result in a new firearm sight which is not anticipated, rendered obvious, suggested, or even implied by any of the prior art firearm sight, either alone or in any combination thereof.

To attain this, the present invention generally comprises an elongate member being adapted for mounting on a barrel of a firearm. The elongate member includes an elongate base portion for mounting on the firearm and having a proximal end and a distal end. The elongate member also includes an elongate upper portion mounted on the base portion and has a substantially V-shaped cross section. The upper portion comprises a pair of side walls. A sighting member is mounted on the elongate member, and extends between the side walls of the upper portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new firearm sight which has many of the advantages of the firearm sight mentioned heretofore and many novel features that result in a new firearm sight which is not anticipated, rendered obvious, suggested, or even implied by any of the prior art firearm sight, either alone or in any combination thereof.

It is another object of the present invention to provide a new firearm sight which may be easily and efficiently manufactured and marketed.

It is a further object of the present invention to provide a new firearm sight which is of a durable and reliable construction.

An even further object of the present invention is to provide a new firearm sight which is susceptible of a low cost of manufacture with regard to both materials and labor, and which accordingly is then susceptible of low prices of sale to the consuming public, thereby making such firearm sight economically available to the buying public.

Still yet another object of the present invention is to provide a new firearm sight which provides in the apparatuses and methods of the prior art some of the advantages thereof, while simultaneously overcoming some of the disadvantages normally associated therewith.

Still another object of the present invention is to provide a new firearm sight for providing the user with a consistent reference point for his sighting.

Yet another object of the present invention is to provide a new firearm sight which includes an elongate member being adapted for mounting on a barrel of a firearm. The elongate member includes an elongate base portion for mounting on the firearm and having a proximal end and a distal end. The elongate member also includes an elongate upper portion mounted on the base portion and has a substantially V-shaped cross section. The upper portion comprises a pair of side walls. A sighting member is mounted on the elongate member, and extends between the side walls of the upper portion.

Still yet another object of the present invention is to provide a new firearm sight that maintains a proper retina alignment to better focus at the same point for every shot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
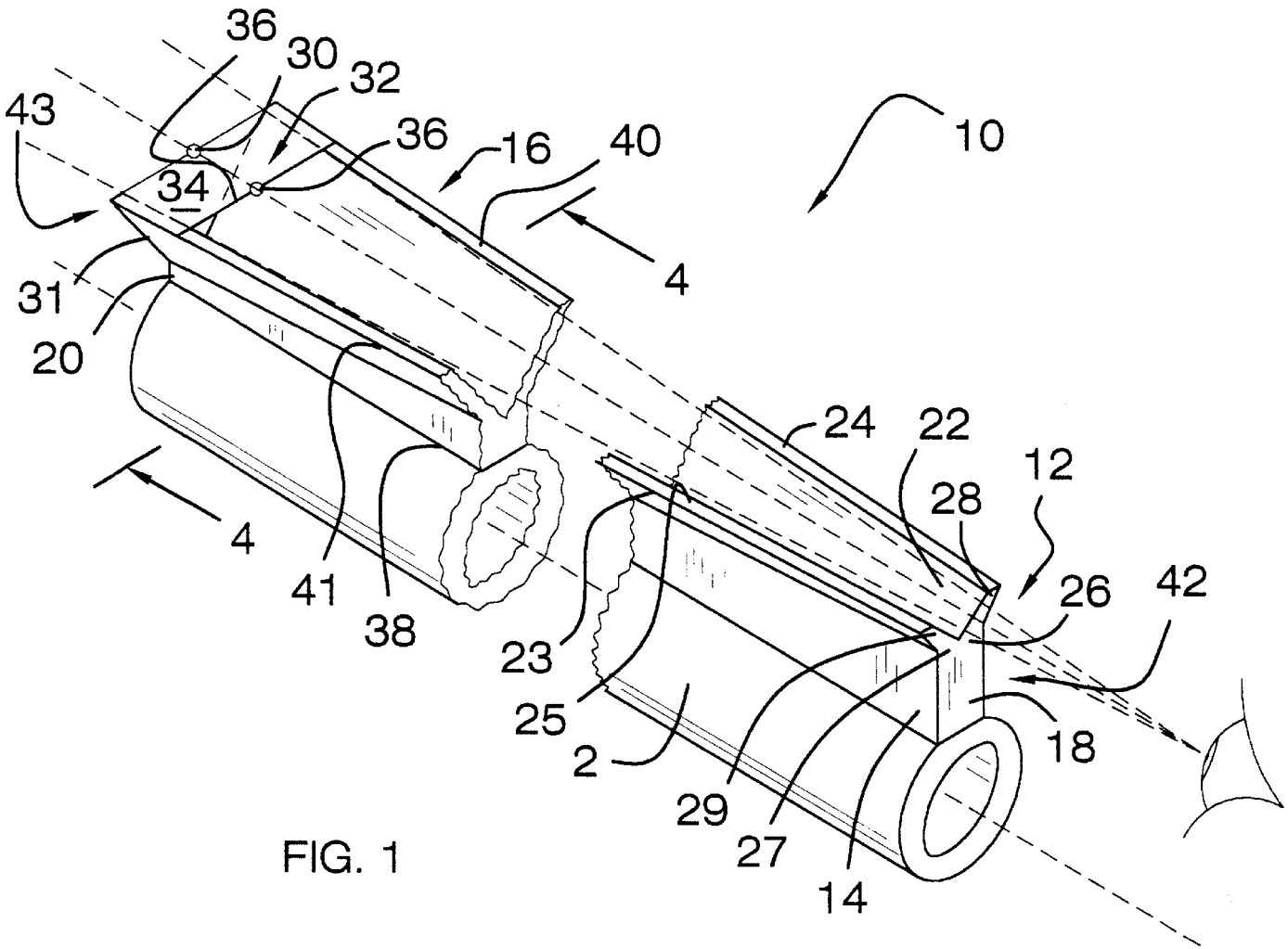
FIG. 1 is a perspective view of a new firearm sight according to the present invention.
Figure 2:
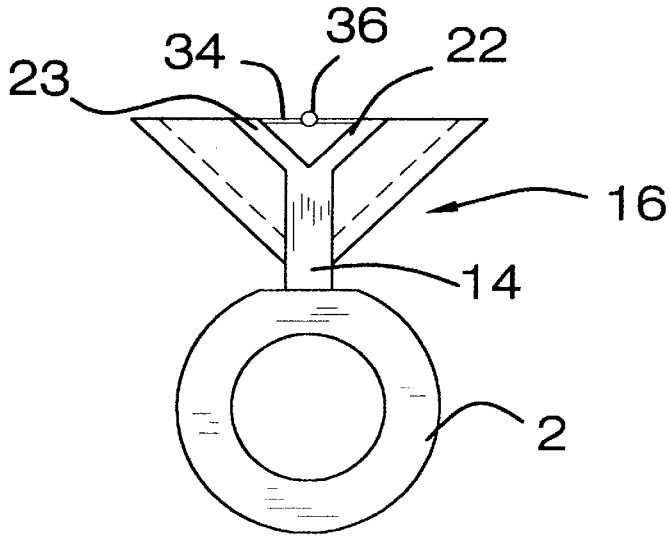
FIG. 2 is an end view of the present invention.
Figure 3:
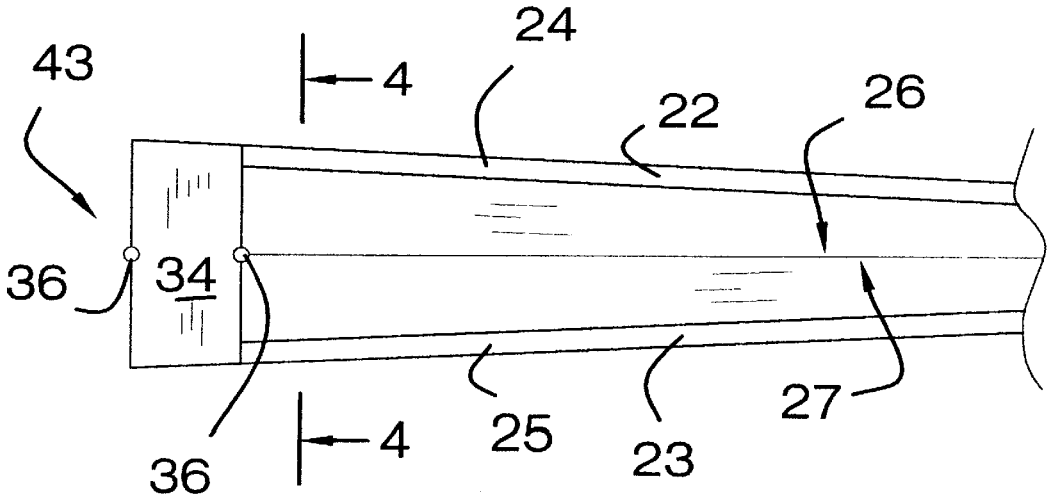
FIG. 3 is a top view of the present invention.
Figure 4:
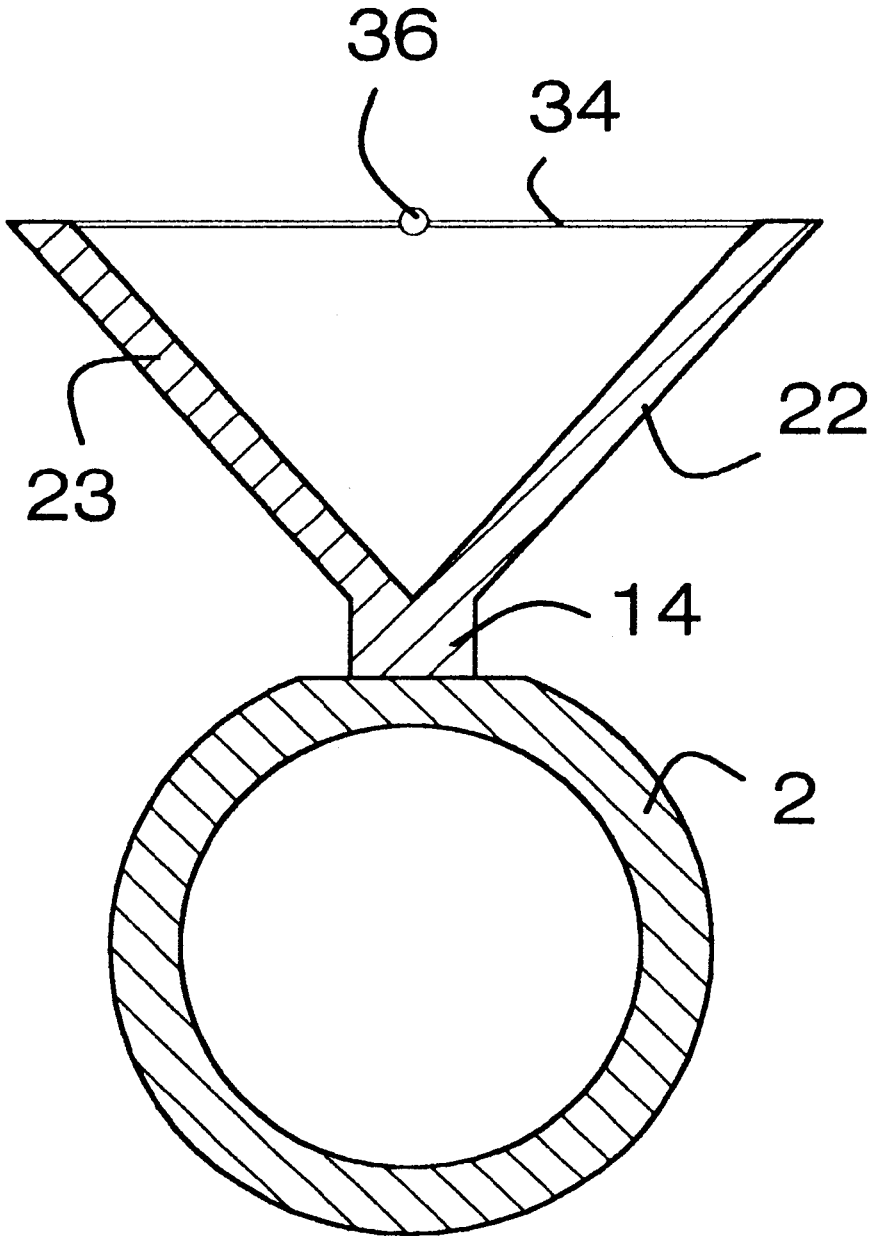
FIG. 4 is a cross-sectional view of the present invention taken along line 4—4 of FIG. 3.

With reference now to the drawings, and in particular to FIGS. 1 through 4 thereof, a new firearm sight embodying the principles and concepts of the present invention and generally designated by the reference numeral 10 will be described.

As best illustrated in FIGS. 1 through 4, the firearm sight 10 generally comprises an elongate member 12 that is adapted for mounting on a barrel 2 of a firearm. The elongate member 12 may comprise an elongate base portion 14 and an elongate upper portion 16.

The base portion 14 may be mountable on the firearm. The base portion 14 has a proximal end 18 and a distal end 20. The base portion 14 has a height greater toward the proximal end 18 than a height of the base portion 14 at the distal end 20.

The elongate upper portion 16 is mounted on the base portion 14. The upper portion 16 has a substantially V-shaped cross section. The upper portion 16 includes a pair of side walls 22 and 23. The side walls 22 and 23 each have upper ends 24 and 25 and lower ends 26 and 27. The lower ends 26 and 27 converge toward each other and the upper ends 24 and 25 diverge away from each other. The lower ends 26 and 27 are mounted together.

The side walls 22 and 23 further have proximal ends 28 and 29 and distal ends 30 and 31. The upper ends 24 and 25 are positioned in spaced relationship to each other to define a width between the upper ends 24 and 25. The width between the upper ends 24 and 25 increases toward the distal ends 30 and 31 and decreases toward the proximal ends 28 and 29. Thus, the V-shaped cross section is larger at the distal ends 30 and 31 than at the proximal ends 28 and 29.

A sighting member 32 is mounted on the elongate member 12. The sighting member 32 extends between the side walls 22 and 23 of the upper portion 16. The sighting member 32 is located at the distal ends 30 and 31 of the side walls 22 and 23. The sighting member 32 bridges between the upper ends 24 and 25 of the side walls 22 and 23. The sighting member 32 comprises a thin planar plate 34 and a knob 36 mounted on the plate 34 approximately midway between the side walls 22 and 23 of the upper portion 16. In an embodiment, a pair of knobs 36 are provided, each being positioned on an associated side edge of the plate 34.

The base portion 14 has a bottom 38 and the side walls 22 and 23 have upper edges 40 and 41. A height of the upper edges 40 and 41 above the bottom 38 of the base portion 14 is substantially constant between opposite ends 42 and 43 of the elongate member 12.

In use, a user looks through the proximal end of the elongate member and aligns the knob or knobs appropriately to enhance aiming of the firearm.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm sighting device for mounting on a barrel of a firearm, comprising:

an elongate member being adapted for mounting on a barrel of a firearm, said elongate member comprising:

an elongate base portion for mounting on the firearm, the base portion having a proximal end and a distal end;

an elongate upper portion mounted on said base portion, said upper portion having a substantially V-shaped cross section, said upper portion comprising a pair of side walls; and a sighting member mounted on said elongate member, said sighting member extending horizontally between said side walls of said upper portion, said sighting member being located at said distal end of said elongate member.

2. The device of claim 1 wherein said base portion has a height, said height of said base portion being greater toward said proximal end thereof than said height of said base portion at said distal end thereof.

3. The device of claim 1 wherein said side walls each have upper and lower ends, said lower ends of said side walls converging toward each other and said upper ends of said side walls diverging away from each other, said lower ends of said side walls being mounted together.

4. The device of claim 1 wherein said side walls each have proximal and distal ends, said upper ends of said side walls converging toward each other at said proximal ends of said side walls, said upper ends of said side walls diverging away from each other toward said distal ends of said side walls.

5. The device of claim 1 wherein said side walls each have proximal and distal ends, each of said side walls having a width, said width of said side walls increasing toward said distal ends and decreasing toward said proximal ends.

6. The device of claim 1 wherein said side walls each have proximal and distal ends, and said V-shaped cross section is larger at said distal end of said side walls than at said proximal ends of said side walls.

7. The device of claim 1 wherein said sighting member bridges between said upper ends of said side walls.

8. The device of claim 1 wherein said sighting member comprises a thin planar plate and a knob mounted on said plate approximately midway between said side walls of said upper portion.

9. The device of claim 1 wherein said base portion has a bottom and said side walls of said upper portion each have an upper edge, and a height of said upper edges above said bottom of said base portion is substantially constant between ends of said elongate member.

10. The device of claim 1, further comprising:

said base portion having a height, said height of said base portion being greater toward said proximal end thereof than said height of said base portion at said distal end thereof;

wherein said side walls each have upper and lower ends, said lower ends of said side walls converging toward each other and said upper ends of said side walls diverging away from each other, said lower ends of said side walls being mounted together, wherein said side walls each have proximal and distal ends, said upper ends of said side walls being positioned in spaced relationship to each other to define a width between said upper ends of said side walls, said width between said upper ends of said side walls increasing toward said distal ends and decreasing toward said proximal ends whereby said V-shaped cross section is larger at said distal end of said side walls than at said proximal ends of said side walls; and said sighting member bridging between said upper ends of said side walls, said sighting member comprising a thin planar plate and a knob mounted on said plate approximately midway between said side walls of said upper portion;

wherein said base portion has a bottom and said sidewalls of said upper portion each have an upper edge, and a height of said upper edges above said bottom of said base portion is substantially constant between ends of said elongate member.

11. The device of claim 1 wherein said sighting member comprises a thin planar plate and a pair of knobs, each of said knobs being mounted on an associated edge of said plate approximately midway between said side walls of said upper portion.

12. The device in claim 1, further comprising:

said base portion having a height, said height of said base portion being greater toward said proximal end thereof than said height of said base portion at said distal end thereof;

wherein said side walls each have upper and lower ends, said lower ends of said side walls converging toward each other and said upper ends of said side walls diverging away from each other, said lower ends of said side walls being mounted together, wherein said side walls each have proximal and distal ends, said upper ends of said side walls being positioned in spaced relationship to each other to define a width between said upper ends of said side walls, said width between said upper ends of said side walls increasing toward said distal ends and decreasing toward said proximal ends whereby said V-shaped cross section is larger at said distal end of said side walls than at said proximal ends of said side walls; and said sighting member bridging between said upper ends of said side walls, said sighting member comprising a thin planar plate and a pair of knobs, each of said knobs being mounted on an associated edge of said plate approximately midway between said side walls of said upper portion;

wherein said base portion has a bottom and said side walls of said upper portion each have an upper edge, and a height of said upper edges above said bottom of said base portion is substantially constant between ends of said elongate member.

13. A firearm sighting device for mounting on a barrel of a firearm, comprising:

an elongate member being adapted for mounting on a barrel of a firearm, said elongate member comprising:

an elongate base portion for mounting on the firearm, the base portion having a proximal end and a distal end;

an elongate upper portion mounted on said base portion, said upper portion having a substantially V-shaped cross section, said upper portion comprising a pair of side walls;

a sighting member mounted on said elongate member, said sighting member extending between said side walls of said upper portion; and said sighting member comprising a thin planar plate and a knob mounted on said plate approximately midway between said side walls of said upper portion.

14. A firearm sighting device for mounting on a barrel of a firearm, comprising:

an elongate member being adapted for mounting on a barrel of a firearm, said elongate member comprising:

an elongate base portion for mounting on the firearm, the base portion having a proximal end and a distal end;

an elongate upper portion mounted on said base portion, said upper portion having a substantially V-shaped cross section, said upper portion comprising a pair of side walls;

a sighting member mounted on said elongate member, said sighting member extending between said side walls of said upper portion; and said sighting member comprising a thin planar plate and a pair of knobs, each of said knobs being mounted on an associated edge of said plate approximately midway between said side walls of said upper portion.

* * * * *